US010439283B2

(12) United States Patent
Zhai

(10) Patent No.: US 10,439,283 B2
(45) Date of Patent: Oct. 8, 2019

(54) HIGH COVERAGE ANTENNA ARRAY AND METHOD USING GRATING LOBE LAYERS

(71) Applicant: Huawei Technologies Co., Ltd., Shenzhen (CN)

(72) Inventor: Wenyao Zhai, Kanata (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 682 days.

(21) Appl. No.: 14/569,378

(22) Filed: Dec. 12, 2014

(65) Prior Publication Data

US 2016/0172754 A1 Jun. 16, 2016

(51) Int. Cl.

| | |
|---|---|
| ***H01Q 3/00*** | (2006.01) |
| ***H01Q 3/30*** | (2006.01) |
| ***H01Q 21/00*** | (2006.01) |
| ***H01Q 21/30*** | (2006.01) |
| *H01Q 25/00* | (2006.01) |
| *H01Q 3/26* | (2006.01) |
| *H01Q 21/06* | (2006.01) |

(52) U.S. Cl.

CPC ..... *H01Q 3/30* (2013.01); *H01Q 21/0087* (2013.01); *H01Q 21/30* (2013.01); *H01Q 3/26* (2013.01); *H01Q 21/065* (2013.01); *H01Q 25/00* (2013.01)

(58) Field of Classification Search

CPC ..... H01Q 3/26; H01Q 3/30; H01Q 21/0087; H01Q 21/065; H01Q 21/30; H01Q 25/00

USPC ..... 342/368, 371, 372

See application file for complete search history.

(56) References Cited

U.S. PATENT DOCUMENTS 3,938,161 A * 2/1976 Sanford ..... H01Q 9/0407 343/829

4,833,482 A * 5/1989 Trinh ..... H01Q 21/0075 343/700 MS (Continued)

FOREIGN PATENT DOCUMENTS

CN 1226344 A 8/1999

CN 1914766 A 2/2007

(Continued)

OTHER PUBLICATIONS

Ali et al., "Design and Implemenation of Two-Layer Compact Wideband Butler Matrices in SIW Technology for Ku-Band Applications," IEEE Transaction on Antennas and Propagation, vol. 59, No. 2, Feb. 2011, pp. 503-512.

(Continued)

*Primary Examiner* — Chuong P Nguyen

(74) *Attorney, Agent, or Firm* — Slater Matsil, LLP

(57) ABSTRACT

An embodiment antenna having first dimension and second planar arrays. The first array has a first element spacing in an x- and a y-dimension and is operable in a first frequency band. The second array has a second element spacing in the x-dimension and the y-dimension, and is operable in a second frequency band. The second planar array is displaced from the first planar array in a z-dimension for co-aperture operation of the arrays, and is disposed parallel to and in a near-field of the first planar array. Elements of the second planar array are disposed and steerable, in a u-v plane for interleaving a first plurality of grating lobes generated by the first planar array with a second plurality of grating lobes generated by the second planar array.

23 Claims, 8 Drawing Sheets

(56) References Cited

U.S. PATENT DOCUMENTS 5,262,791 A * 11/1993 Tsuda ..... H01Q 5/42 343/700 MS
5,389,939 A * 2/1995 Tang ..... H01Q 3/46 343/753
5,485,167 A * 1/1996 Wong ..... H01Q 21/062 343/753
5,576,718 A * 11/1996 Buralli ..... H01Q 21/065 343/700 MS
5,612,702 A * 3/1997 Kinsey ..... G01S 13/4409 342/149
5,952,971 A * 9/1999 Strickland ..... H01Q 1/38 343/700 MS
6,114,998 A * 9/2000 Schefte ..... H01Q 1/243 343/700 MS
6,121,931 A * 9/2000 Levi ..... H01Q 21/065 343/700 MS
6,175,333 B1 * 1/2001 Smith ..... H01Q 1/38 343/700 MS
6,211,841 B1 * 4/2001 Smith ..... H01Q 1/246 343/797
6,388,631 B1 * 5/2002 Livingston ..... H01Q 3/24 342/374
6,795,020 B2 * 9/2004 Sreenivas ..... H01Q 1/38 343/700 MS
6,937,206 B2 * 8/2005 Puente Baliarda .... H01Q 1/246 343/700 MS
6,965,349 B2 * 11/2005 Livingston ..... H01Q 1/422 342/374
7,026,995 B2 * 4/2006 Sreenivas ..... H01O 1/38 343/700 MS
7,466,262 B2 * 12/2008 Stephens ..... G01S 3/50 342/126
7,639,197 B1 * 12/2009 Herting ..... H01P 1/181 333/157
7,808,443 B2 * 10/2010 Lindmark ..... H01Q 1/523 343/815
7,868,828 B2 * 1/2011 Shi ..... H01Q 1/32 343/700 MS
9,541,639 B2 * 1/2017 Searcy ..... G01S 7/03
9,568,600 B2 * 2/2017 Alland ..... G01S 13/4454
2003/0137456 A1 7/2003 Sreenivas et al.
2004/0155820 A1 * 8/2004 Sreenivas ..... H01Q 1/38 343/700 MS
2007/0200760 A1 * 8/2007 Hjelmstad ..... G01S 3/023 342/417
2007/0257853 A1 11/2007 Gevorgian et al.
2010/0149068 A1 6/2010 Petersson et al.
2012/0249374 A1 10/2012 Wang
2014/0066757 A1 * 3/2014 Chayat ..... G01S 13/89 600/430
2014/0266897 A1 * 9/2014 Jakoby ..... H01Q 1/38 342/368
2015/0253419 A1 * 9/2015 Alland ..... G01S 7/02 342/385
2015/0372396 A1 * 12/2015 Sienkiewicz ..... H01Q 21/08 455/77

FOREIGN PATENT DOCUMENTS

CN 101359777 A 2/2009
CN 101663796 A 3/2010
CN 102280714 A 12/2011
CN 102842752 A 12/2012
CN 103975483 A 8/2014
WO 2013045267 A1 4/2013

OTHER PUBLICATIONS

Djerafi et al., "Design and Implementation of a Planar 4+4 Butler Matrix in Siw Technology for Wide Band High Power Applications," Progress in Electromagnetics Research B, vol. 35 (no month 2011) pp. 29-51.
Kramer et al., "Very Small Footprint 60 GHz Stacked Yagi Antenna Array," IEEE Transactions on Antennas and Propagation, Vo. 59, No. 9, Sep. 2011, pp. 3204-3210.
Wei et al., "Design of an X/Ka Dual-Band Co-Aperture Broadband Microstrip Antenna Array," IEEE International Conference on Microwave Technology & Computational Electromagnetics (ICMTCE), May 22-25, 2011, pp. 217-220.

* cited by examiner

HIGH COVERAGE ANTENNA ARRAY AND METHOD USING GRATING LOBE LAYERS

TECHNICAL FIELD

The present invention relates generally to a high-gain broad coverage antenna array and method of using its grating lobes, and in particular embodiments, to an antenna array, a dual-band antenna array, and methods of constructing and using an antenna array.

BACKGROUND

In high-frequency wireless communication systems, high antenna gain and directivity, and broad coverage are typically design trade-offs. Wireless communication systems having broad coverage often sacrifice beam directivity and efficiency. Broader coverage allows an antenna system to potentially serve more users and more devices. Likewise, wireless communication systems having good directivity and a high gain antenna system having long link distances, do so at the expense of coverage area.

Directivity is generally a characteristic of a main lobe or main beam generated by the antenna or antenna array. Antenna arrays are typically designed to avoid grating lobes that draw power from the main beam, although many arrays still generate grating lobes when steering the main beam. Directivity characterizes the ability of the antenna to focus power in a particular direction, an increase in which narrows the coverage of the antenna.

SUMMARY

An embodiment antenna system includes a first and second planar array. The first array has a first element spacing in an x-dimension and a y-dimension and is operable in a first frequency band. The second array has a second element spacing in the x-dimension and the y-dimension, and is operable in a second frequency band. The second planar array is displaced from the first planar array in a z-dimension for co-aperture operation of the first and second planar arrays. The second planar array is disposed parallel to and in a near-field of the first planar array. Elements of the second planar array are disposed and steerable, in a u-v plane for interleaving a first plurality of grating lobes generated by the first planar array with a second plurality of grating lobes generated by the second planar array.

An embodiment method of using a dual-band antenna includes a first planar array radiating, in a first frequency band, a first main lobe having a first beam direction. The first planar array also radiates, in the first frequency band, a first plurality of grating lobes according to the first beam direction and a first element spacing for the first planar array. The method also includes a second planar array radiating, in a second frequency band, a second main lobe having a second beam direction. The second planar array also radiates, in the second frequency band, a second plurality of grating lobes according to the second beam direction and a second element spacing for the second planar array. The second plurality of grating lobes are interleaved with the first plurality of grating lobes.

An embodiment method of constructing an antenna system includes forming a first planar array of radiating elements having a first element spacing related to a first wavelength. The first planar array is configured to generate a first plurality of grating lobes according to the first element spacing. The method also includes forming a second planar array of radiating elements having a second element spacing related to a second wavelength. The second planar array is configured to generate a second plurality of grating lobes according to the second element spacing. The method also includes coupling the first planar array to the second planar array in a co-aperture fashion. A first plane of the first planar array and a second plane of the second planar array are both configured to radiate in a same direction, such as boresight. The first planar array and the second planar array comprise a top planar array disposed in a near-field of a bottom planar array. The radiating elements of the second planar array are disposed in the second plane to interleave the second plurality of grating lobes among the first plurality of grating lobes to fill nulls among the first plurality of grating lobes.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of embodiments are discussed in detail below. It should be appreciated, however, that the present invention provides many applicable inventive concepts that may be embodied in a wide variety of specific contexts. The specific embodiments discussed are merely illustrative of specific ways to make and use the invention, and do not limit the scope of the invention.

Figure 1:
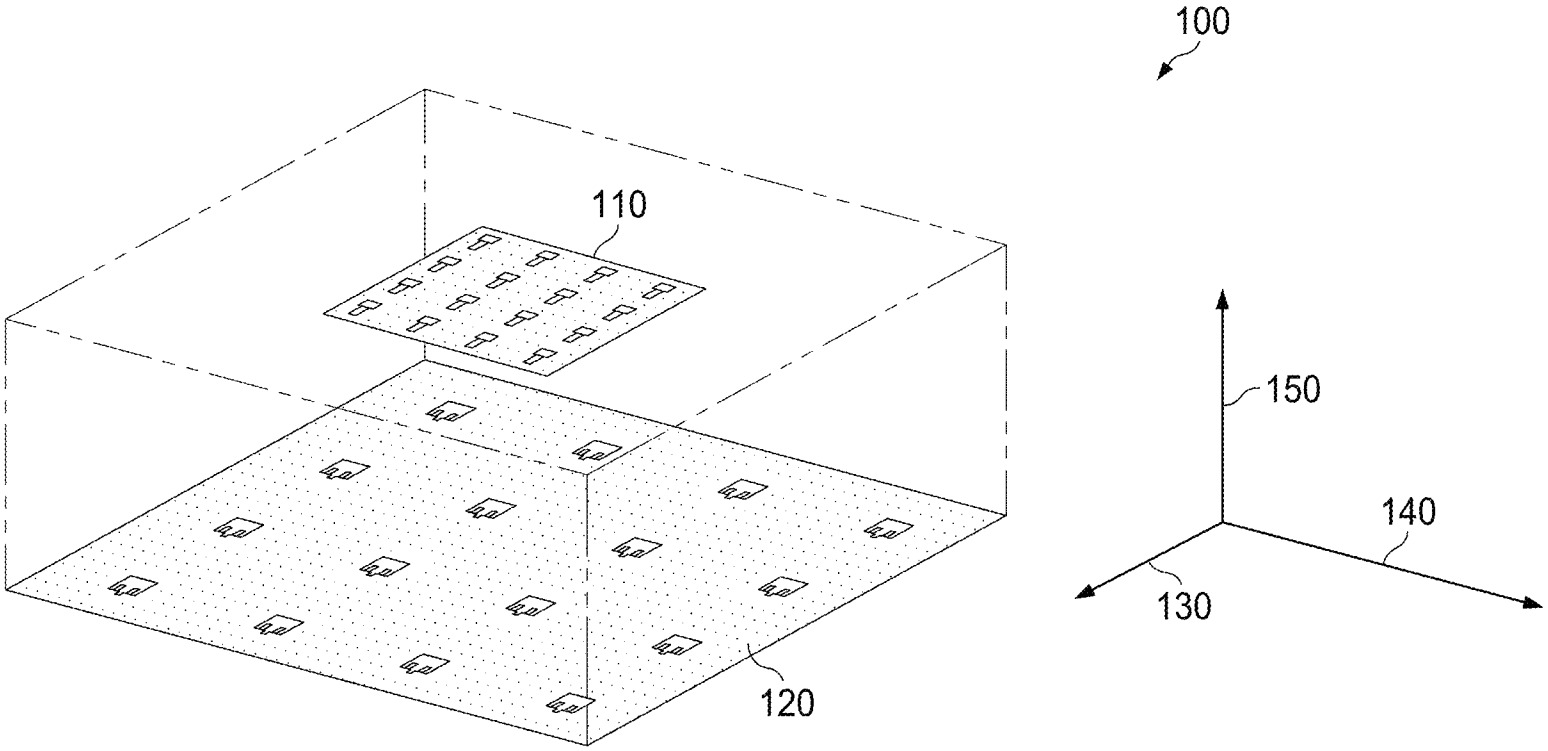
FIG. 1 is a diagram illustrating one embodiment of a dual-band antenna array.

FIG. 1 is a diagram of one embodiment of a dual-band antenna 100. Dual-band antenna 100 includes a first planar array 110 and a second planar array 120. First planar array 110 is disposed parallel to second planar array 120. The two planes are separated by a distance in a Z-dimension 150, however first planar array 110 is in the near-field of second planar array 120. The two arrays are configured to operate in a co-aperture fashion.

The respective planes of first planar array 110 and second planar array 120 are defined in an X-dimension 130 and a Y-dimension 140. The radiating elements of first planar array 110 are separated by an element spacing in X-dimension 130 and Y-dimension 140. The element spacing is generally uniform within first planar array 110, which impacts the production of grating lobes. Similarly, radiating elements of second planar array 120 are separated by another element spacing. In the embodiment of FIG. 1, first planar array 110 operates in a first frequency band and second planar array 120 operates in a second frequency band that is distinct from the first. For example, in certain embodiments first planar array 110 is an E-band array and second planar array 120 is a local multipoint distribution system (LDMS) band array. In alternative embodiments, other frequencies can be used. In certain embodiments, a single frequency band may be used for both first planar array 110 and second planar array 120.

Grating lobes typically appear when the uniform spacing within a uniform grid array of radiating elements are spaced at least one wavelength on the antenna array. If the main beam is to be scanned, grating lobes will appear with element spacing less than one wavelength. As the spacing increases beyond one wavelength, multiple grating lobes occur periodically according to how the main lobe is steered. It is realized herein that rather than avoiding the generation of grating lobes, embodiment antenna arrays use them to their advantage. Typical antennas use a single beam that may or may not be steerable. Other solutions may only provide the coverage using a single frequency band.

First planar array 110 is disposed above second planar array 120 and in the X-Y plane in a co-aperture fashion such that grating lobes generated by first planar array 110 are interleaved with the grating lobes generated by second planar array 120. Grating lobes can be achieved with first planar array 110 and second planar array 120 by steering their respective main lobes accordingly. The nulls formed among the main lobe and grating lobes of first planar array 110 are filled by the main lobe and grating lobes of second planar array 120.

Figure 2:
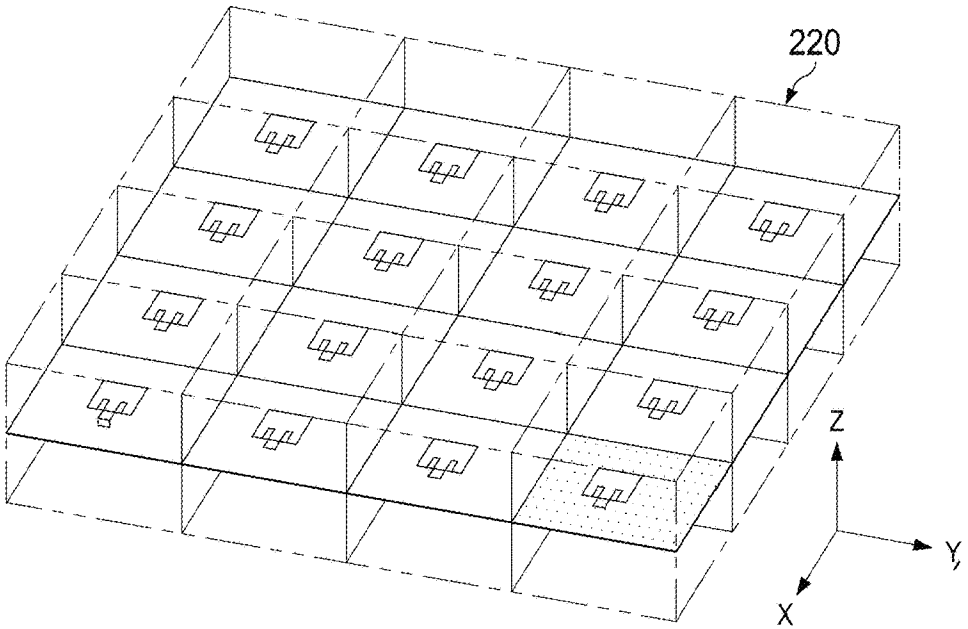
FIG. 2 is a diagram illustrating one embodiment of a radiating element and a planar array.
Figure 2:
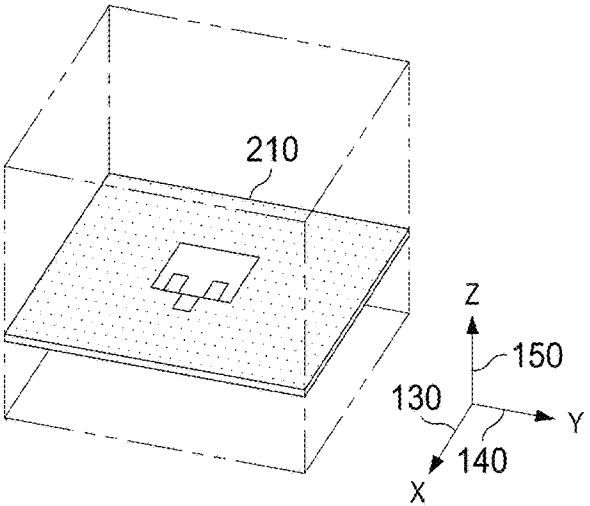

FIG. 2 is a diagram of one embodiment of a radiating element 210 and a planar array 220. Radiating element 210 is illustrated with respect to X-axis 130, Y-axis 140, and Z-axis 150, from FIG. 1. Planar array 220 includes a four-by-four grid of radiating elements similar to radiating element 210. In alternative embodiments, planar array 220 can be arranged in any other shape in two dimensions, i.e., in the X-Y plane. For example, one embodiment can arrange the radiating elements in a grid for a circular lattice or a triangular lattice. The grid of planar array 220 exists in the X-Y plane formed by the X-axis 130 and Y-axis 140. The element spacing between each of the radiating elements in planar array 220 is defined with respect to the wavelength for those radiating elements' operating frequencies. The element spacing is applied in both X-dimension 130 and Y-dimension 140. Planar array 220 can be steered by making phase or delay adjustments to each radiating element.

Figure 3:
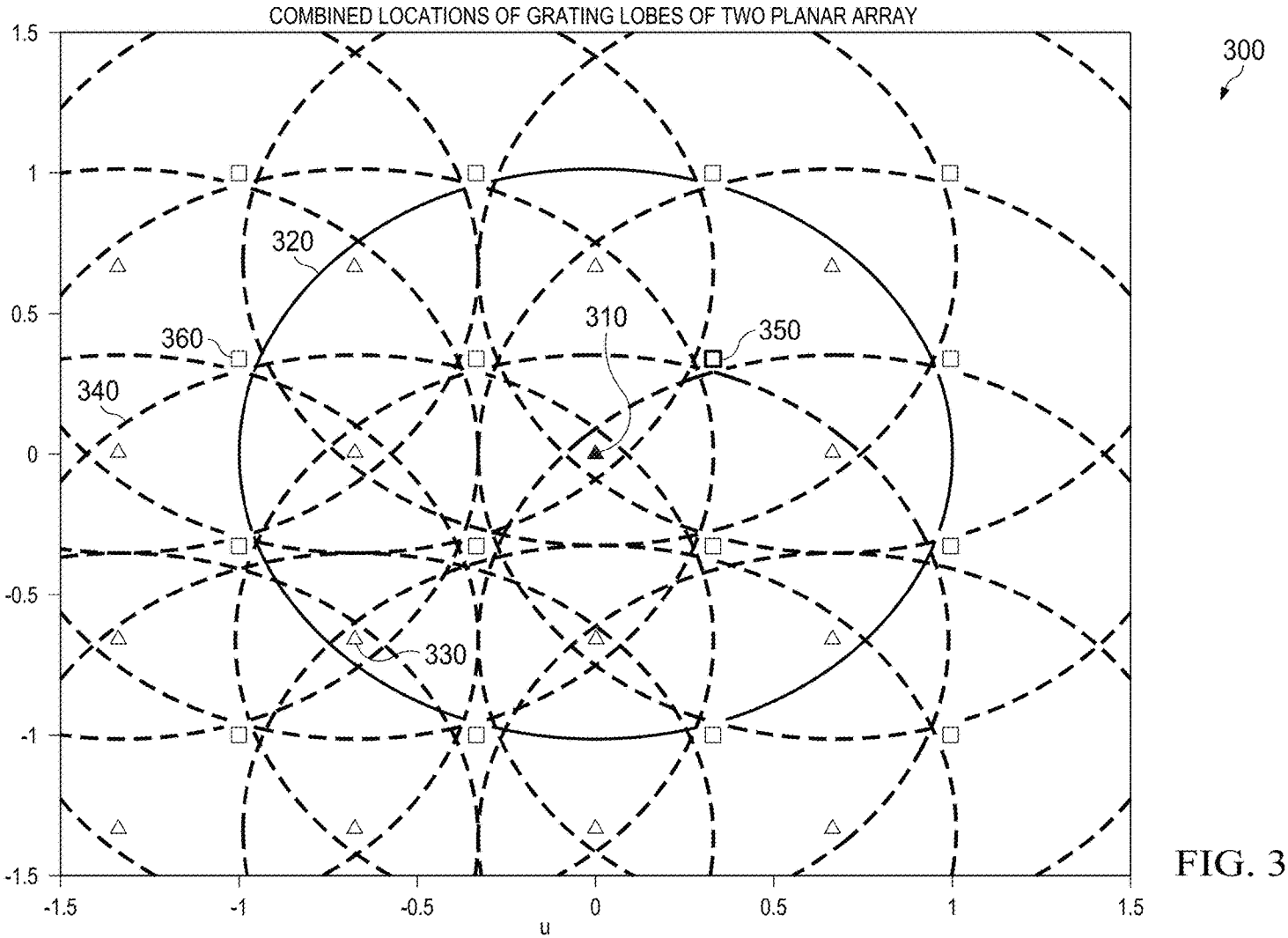
FIG. 3 is an illustration of main lobe and grating lobe locations for an embodiment dual band co-aperture antenna array.

FIG. 3 is an illustrative plot 300, according to an embodiment antenna system, of the locations of respective main lobes and grating lobes of two planar arrays. Plot 300 is a projection of the embodiment antenna's radiation pattern onto the U-V plane, the general direction of radiation being normal to the U-V plane. The direction of the normal vector is referred to as broadside. Directional cosines are applied to the planar arrays to derive plot 300, which is shown in wavelength units. In the plot, $u=\sin\theta\cdot\cos\varphi$ and $v=\sin\theta\cdot\sin\varphi$, where $\theta$ and $\varphi$ are angles in azimuth and elevation planes, respectively.

At the center of plot 300 is a solid black triangle representing the location of a first main lobe 310 generated by the first planar array of the embodiment antenna system. Also centered in plot 300 is a solid black elliptical outline representing an area visible to first main lobe 310, i.e., grating lobes falling within visible area 320 manifest as a resultant array radiation pattern. Plot 300 shows the location of first main lobe 310 as (o, o) in the u-v plane. (o, o) is one possible location for first main lobe 310. Alternatively, first main lobe 310 can be steered within visible area 320.

Plot 300 also illustrates respective locations of a first plurality of grating lobes 330 generated by the first planar array. These locations are represented by unfilled black triangles in plot 300, which are arranged in a grid in the U-V plane. Each of the first plurality of grating lobes 330 has a corresponding visible area 340, which are represented by dashed black elliptical outlines. A given grating lobe is centered within its corresponding visible area, which bounds the positions to which the grating lobe can be steered. The steering of the grating lobes is a function of the steering of the main lobe.

Plot 300 also illustrates respective locations of a second main lobe 350 and corresponding grating lobes 360 generated by a second planar array of the embodiment antenna system. Second main lobe 350 is represented by a bold black unfilled square. Locations of corresponding grating lobes 360 are shown as non-bold black unfilled squares arranged in a grid in the U-V plane. Although not shown in Figure 3, second main lobe 350 and corresponding grating lobes 360 also have respective corresponding visible areas. Second main lobe 350 and corresponding grating lobes 360 are steered by phase shifting or delay line to nulls present in the radiation pattern of the first planar array, thus filling the nulls in the overall radiation pattern for the embodiment antenna system. Rather than suppressing the grating lobes, the embodiment antenna array interleaves the grating lobes to provide broader coverage.

Figure 4:
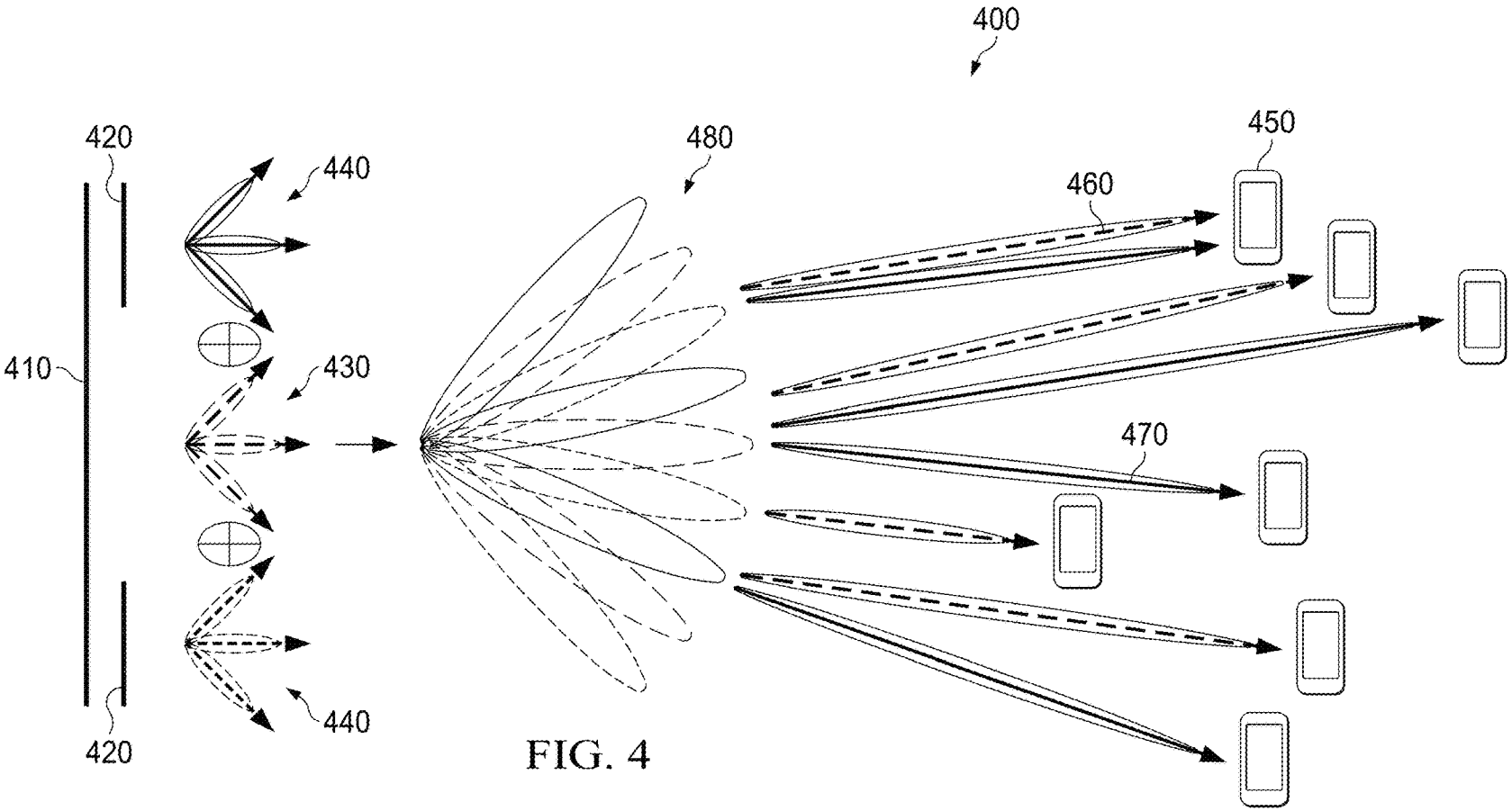
FIG. 4 is an illustration of an embodiment antenna system in a line-of-sight (LOS) system.

FIG. 4 is a diagram illustrating an embodiment antenna system in a line of sight (LOS) system 400. The embodiment antenna includes a first planar array 410 and a second planar array 420. First planar array 410 and second planar array 420 are shown as a cross-section of the X-Y plane, where the Z-axis is the general direction of radiation, e.g., boresight. Second planar array 420 is separated from first planar array 410 in the Z-dimension and is disposed in the near-field of first planar array 410.

Elements of first planar array 410 are steered to generate a radiation pattern 430 and elements of second planar array 420 are steered to generate radiation patterns 440. The radiation patterns include a main lobe and grating lobes. As a whole, first planar array 410 and second planar array 420 generate a beam pattern 480 such that grating lobes from each planar array are interleaved to fill nulls is the radiation patterns. In LOS system 400, multiple devices 450 are configured to receive the beams from the embodiment antenna system. FIG. 4 illustrates the coverage provided by the grating lobes fills nulls that would otherwise leave one or more of devices 450 without coverage. Some devices receive beams 460 generated by first planar array 410, which are represented by dashed arrows. Some devices receive beams 470 generated by second planar array 420, which are represented by solid arrows. In some cases, a device can receive both beams 460 and 470. When grating lobes are generated, beams are more concentrated and increase the possibility of supporting more devices. In certain embodiments, first planar array 410 and second planar array 420 use distinct frequency bands.

Figure 5:
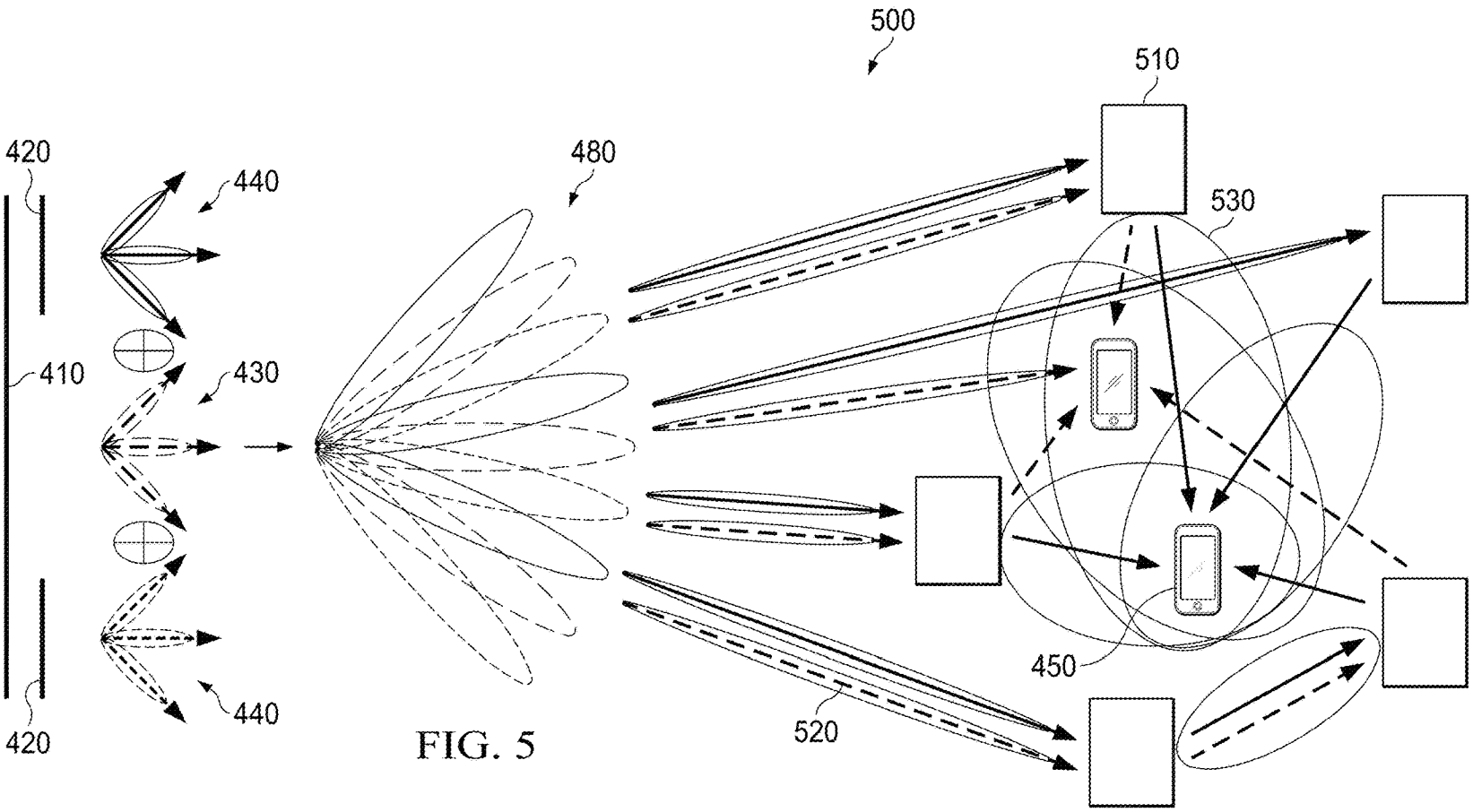
FIG. 5 is an illustration of an embodiment antenna system in a multi-path or non-line-of-sight (NLOS) system.

FIG. 5 is a diagram illustrating an embodiment antenna system in a multi-path or NLOS system 500. FIG. 5 again depicts the embodiment antenna of FIG. 4, this time in multi-path system 500. Multi-path system 500 includes obscurations 510 that scatter beams 520 generated by the embodiment antenna. Devices 450 sometimes must rely on these scattered beams 530 for service. When grating lobes are generated, the multiple beams provide broader coverage that increases the likelihood that devices 450 can receive the signal in scattered beams 530.

Figure 6:
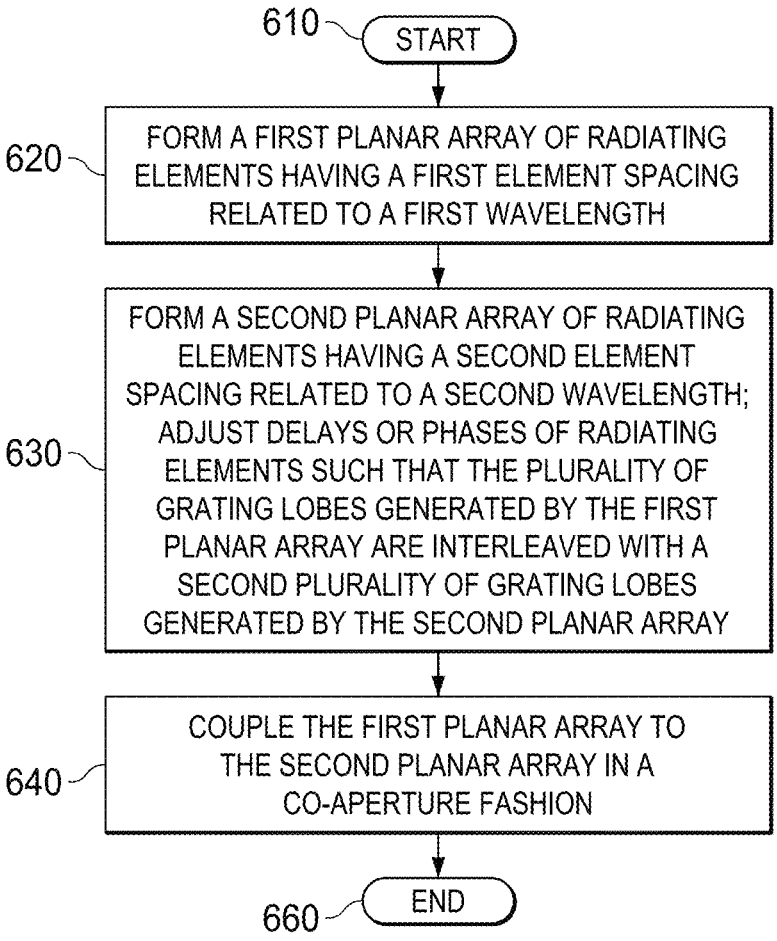
FIG. 6 is a flow diagram of one embodiment of a method of constructing an antenna array.

FIG. 6 is a flow diagram of one embodiment of a method of constructing an antenna. The method begins at a start step 610. At a first forming step 620, a first planar array of radiating elements is formed. The radiating elements can be a variety of types, such as microstrip patch antenna, for example. The radiating elements of the first planar array are arranged in a grid with a first element spacing. The first element spacing is expressed in terms of a wavelength for the first planar array's operating frequency. For example, the first element spacing may be 1.5 times the wavelength for the first planar array. In another embodiment, the first element spacing may be 1.75 times the wavelength. The first element spacing is selected in the design of the first planar array such that the first planar array will generate grating lobes in addition to the main lobe. When the main lobe is steered and grating lobes are generated periodically according to the steered main beam, nulls can appear between them.

At a second forming step 630, a second planar array of radiating elements is formed. The radiating elements of the second planar array are similarly arranged in a grid with a second element spacing. The second element spacing is expressed in terms of a wavelength for the second planar array's operating frequency. The second element spacing is also selected in the design of the second planar array such that grating lobes will be generated in addition to its main lobe. The wavelength, i.e., reciprocal of its operating frequency, of the second planar array is not necessarily the same as that of the first planar array. In some embodiments, the frequency band of the first planar array is distinct from the frequency band of the second planar array. In other embodiments, the first and second planar arrays operate in the same frequency band. The main beam of the second planar array is steered to a position in the u-v plane such that its plurality of grating lobes are interleaved with a first plurality of grating lobes generated by the first planar array. Steering is achieved by adjusting delays or phases of radiating elements.

At a coupling step 640, the first planar array is coupled to the second planar array in a co-aperture fashion. The two planar arrays are coupled such that their respective planes are parallel, i.e., share a normal vector, and resulting beams and grating lobes are radiating at boresight. In one embodiment, the co-aperture arrangement arranges one of the planar arrays disposed on top of the other, separated by a distance, but such that the top planar array is in the near-field of the bottom planar array. The two planar arrays can be coupled, for example, by standoffs. The coupling can include clamping at least one standoff between the first planar array and the second planar array. The two planar arrays, in other embodiments, can be mounted on a structure that disposes the two planar arrays according to embodiments described herein. The two planar arrays are disposed in the X-Y dimensions and steered such that the respective grating lobes generated by the first and second planar arrays are interleaved, covering each other's nulls. The grating lobes generated by the first planar array may leave nulls in the radiation pattern that are filled by the interleaved grating lobes of the second planar array. The method then ends at an end step 650.

Figure 7:
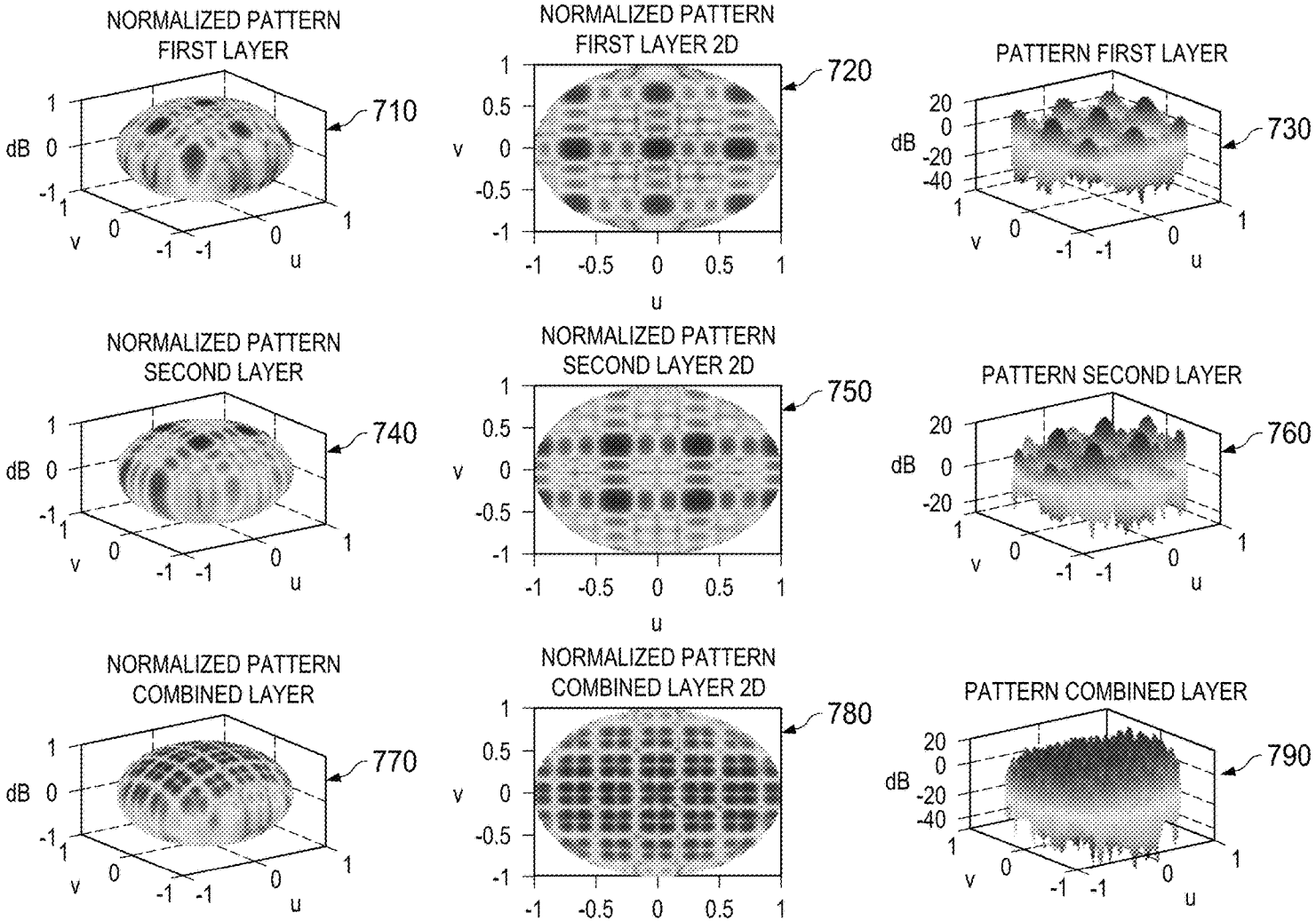
FIG. 7 illustrates plots of radiation patterns of an embodiment antenna array's common frequencies.

FIG. 7 includes multiple plots of radiation patterns of an embodiment antenna arrays having two homogeneous-frequency planar arrays, i.e., the two planar arrays operate in the same frequency band. In the plots of FIG. 7, darker spots indicate higher radiated power density and lighter spots indicate lower radiated power density. Plot 710 illustrates a normalized radiation pattern for the first of the two planar arrays. Plot 720 shows a projection of the normalized radiation pattern onto the U-V plane. At the center of plot 720 is a dark spot representing the main lobe generated by the first planar array. The surrounding grid of dark spots represent the periodic grating lobes corresponding to the main lobe. The lighter spots among the main lobe and grating lobes represent nulls in the radiation pattern of the first planar array. Plot 730 illustrates a non-normalized radiation pattern for the first of the two planar arrays.

Plot 740 illustrates a normalized radiation pattern for the second of the two planar arrays. Plot 750 shows a projection of the normalized radiation pattern onto the U-V plane. Around the center of plot 750 are four dark spots that represent a main lobe and corresponding periodic grating lobes generated by the second planar array. As can be seen in plot 750, like plot 720 for the first planar array, nulls are also present in the radiation pattern of the second planar array. Plot 760 illustrates a non-normalized radiation pattern for the second of the two planar arrays.

Plot 770 illustrates a normalized combination radiation pattern for the first and second planar arrays. Plot 780 shows the projection of the combination onto the U-V plane. Observing the progression from plot 720 to 750 to 780, it is clear the main lobe and corresponding grating lobes of one planar array interleave the main lobe and corresponding grating lobes of the other planar array, covering the nulls. The result, shown in plot 780, is a broad coverage antenna without sacrificing directivity and range. Plot 790 illustrates the combined radiation pattern without normalization.

Figure 8:
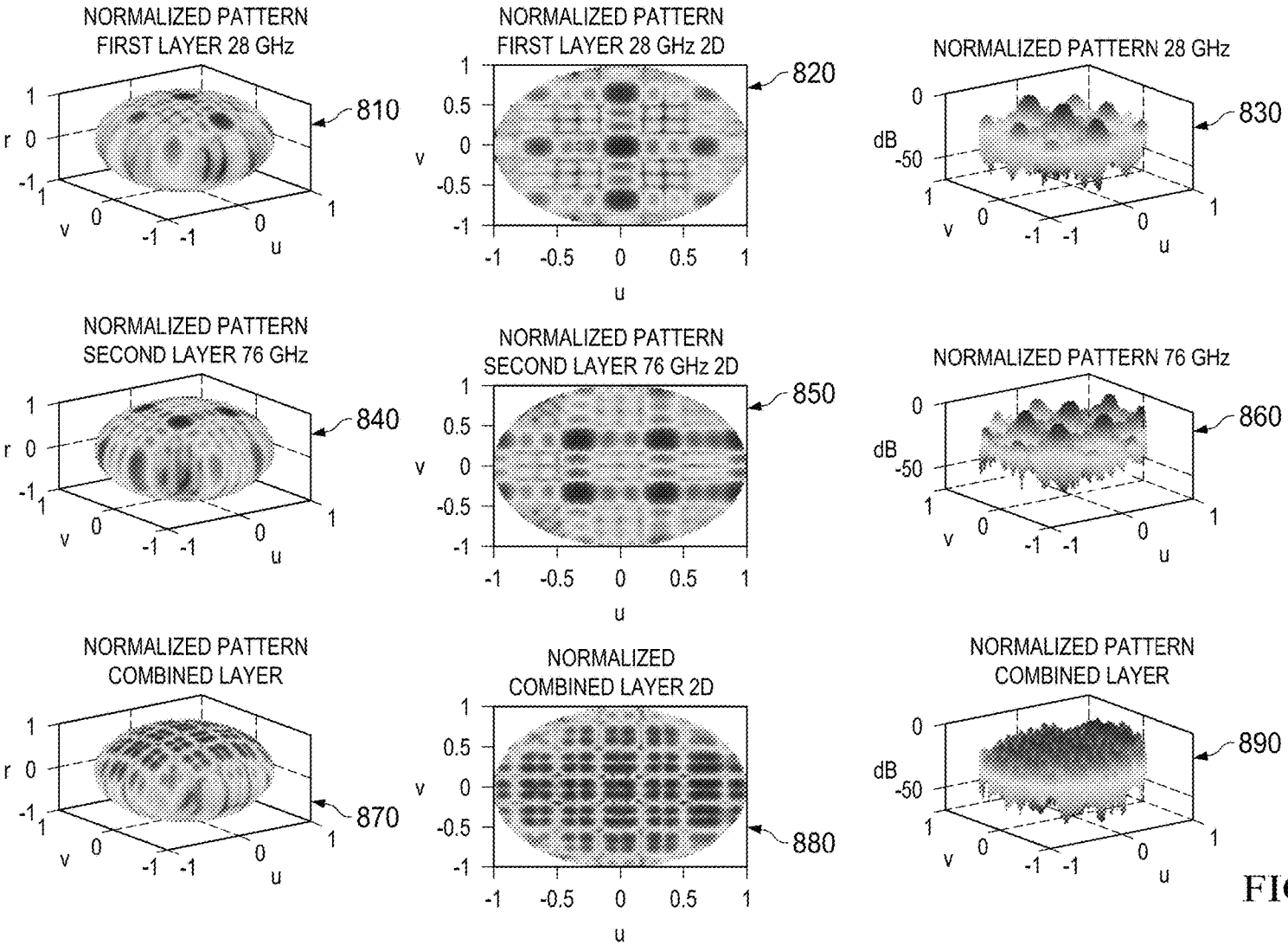
FIG. 8 illustrates plots of radiation patterns of another embodiment antenna array's common frequencies.

FIG. 8 includes multiple plots of radiation patterns of an embodiment antenna arrays having two in-homogeneous-frequency planar arrays, i.e., the two planar arrays operate in distinct frequency bands. In the plots of FIG. 8, as in FIG. 7, darker spots indicate higher radiated power density and lighter spots indicate lower radiated power density. Plot 810 illustrates a normalized radiation pattern for the first of the two planar arrays. Plot 820 shows a projection of the normalized radiation pattern onto the U-V plane. At the center of plot 820 is a dark spot representing the main lobe generated by the first planar array. The surrounding grid of dark spots represent the periodic grating lobes corresponding to the main lobe. The lighter spots among the main lobe and grating lobes represent nulls in the radiation pattern of the first planar array. Plot 830 illustrates a non-normalized radiation pattern for the first of the two planar arrays.

Plot 840 illustrates a normalized radiation pattern for the second of the two planar arrays. Plot 850 shows a projection of the normalized radiation pattern onto the U-V plane. Around the center of plot 850 are four dark spots that represent a main lobe and its corresponding periodic grating lobes generated by the second planar array. As can be seen in plot 850, like plot 820 for the first planar array, nulls are also present in the radiation pattern of the second planar array. Plot 860 illustrates a non-normalized radiation pattern for the second of the two planar arrays.

Plot 870 illustrates a normalized combination radiation pattern for the first and second planar arrays. Plot 880 shows the projection of the combination onto the U-V plane. Observing the progression from plot 820 to 850 to 880, it is clear the main lobe and corresponding grating lobes of one planar array interleave the main lobe and corresponding grating lobes of the other planar array, covering the nulls. The result, shown in plot 880, is a broad coverage antenna without sacrificing directivity and range. Plot 890 illustrates the combined radiation pattern without normalization.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. An antenna system, comprising:

a first planar array having a first element spacing in an x-dimension and in a y-dimension sufficient to produce a first plurality of grating lobes, and operable in a first frequency band; and a second planar array having a second element spacing in the x-dimension and in the y-dimension sufficient to produce a second plurality of grating lobes, and operable in a second frequency band, wherein the second planar array and the first planar array are disposed for co-aperture operation of the first planar array and the second planar array, wherein the second planar array is disposed parallel to the first planar array, and wherein elements of the second planar array are disposed and steerable, in a u-v plane, for interleaving the second plurality of grating lobes generated by the second planar array with the first plurality of grating lobes generated by the first planar array.

2. The antenna system of claim 1 wherein elements of the first planar array respectively comprise a microstrip antenna.

3. The antenna system of claim 1 wherein the first planar array is configured to generate a first main lobe and the first plurality of grating lobes in the first frequency band, and wherein the second planar array is configured to generate a second main lobe and the second plurality of grating lobes in the second frequency band.

4. The antenna system of claim 3 wherein the first frequency band comprises an E-band and the second frequency band comprises a local multipoint distribution service (LMDS) band.

5. The antenna system of claim 3 wherein elements of the first planar array are configured to steer the first main lobe to a desired position.

6. The antenna system of claim 1 wherein the first element spacing comprises an x-axis spacing of 1.75 times a first wavelength for the first planar array and a y-axis spacing of 1.75 times the first wavelength.

7. The antenna system of claim 1 wherein the second element spacing comprises an x-axis spacing of 1.5 times a second wavelength for the second planar array and a y-axis spacing of 1.5 times the second wavelength.

8. The antenna system of claim 1 wherein the first planar array comprises a 4×4 uniform amplitude rectangular grid of radiating elements.

9. The antenna system of claim 1 wherein the second planar array is non-coplanar with the first planar array, in a near field of the first planar array, and spaced apart in a z-dimension from the first planar array.

10. A method of using a dual-band antenna, comprising:

radiating, by a first planar array in a first frequency band, a first main lobe having a first beam direction;

radiating, by the first planar array in the first frequency band, a first plurality of grating lobes according to the first beam direction and a first element spacing, sufficient to produce the first plurality of grating lobes, for the first planar array;

radiating, by a second planar array in co-aperture operation with the first planar array, in a second frequency band, a second main lobe having a second beam direction; and radiating, by the second planar array in the second frequency band, a second plurality of grating lobes according to the second beam direction and a second element spacing, sufficient to produce the second plurality of grating lobes, for the second planar array, the second plurality of grating lobes being interleaved with the first plurality of grating lobes.

11. The method of claim 10 wherein the first frequency band is an E-band.

12. The method of claim 10 wherein the first element spacing is at least 1.0 times a first wavelength corresponding to the first frequency band.

13. The method of claim 10 further comprising steering radiating elements of the second planar array.

14. The method of claim 10 wherein the radiating the second main lobe and the radiating the second plurality of grating lobes comprises phase shifting or adjusting delay, causing the second main lobe and the second plurality of grating lobes to interleave with respect to the first main lobe and the first plurality of grating lobes.

15. The method of claim 10, the second planar array being non-coplanar with the first planar array, in a near-field of the first planar array, and spaced apart in a z-dimension from the first planar array, for the co-aperture operation.

16. A method of constructing an antenna system, comprising:

forming a first planar array of radiating elements having a first element spacing related to a first wavelength sufficient to generate a first plurality of grating lobes according to the first element spacing;

forming a second planar array of radiating elements having a second element spacing related to a second wavelength sufficient to generate a second plurality of grating lobes according to the second element spacing; and coupling the first planar array to the second planar array for co-aperture operation, the first planar array and the second planar array being disposed to radiate in a common direction, and the radiating elements of the second planar array being disposed to interleave the second plurality of grating lobes among the first plurality of grating lobes to fill nulls among the first plurality of grating lobes.

17. The method of claim 16 wherein the first wavelength is not equal to the second wavelength.

18. The method of claim 17 wherein the first wavelength corresponds to an E-band frequency band and the second wavelength corresponds to a local multipoint distribution service (LMDS) band frequency band.

19. The method of claim 16 wherein the first element spacing is 1.5 times the first wavelength.

20. The method of claim 16 wherein the coupling comprises coupling the first planar array and the second planar array by standoffs.

21. The method of claim 16 further comprising coupling a first feed network to the first planar array and coupling a second feed network to the second planar array.

22. The method of claim 16 wherein forming the first planar array comprises forming a uniform grid of microstrip radiating elements having the first element spacing.

23. The method of claim 16, the coupling further comprising disposing the second planar array to be non-coplanar with the first planar array, in a near-field of the first planar array, and spaced apart in a z-dimension from the first planar array.

* * * * *